US012228010B1

(12) United States Patent
Alshaarawi et al.

(10) Patent No.: US 12,228,010 B1
(45) Date of Patent: Feb. 18, 2025

(54) EUTECTIC ALLOY SYSTEM FOR CASING-CASING ANNULUS CEMENT REPAIR

(71) Applicant: SAUDI ARABIAN OIL COMPANY, Dhahran (SA)

(72) Inventors: Amjad Alshaarawi, Dhahran (SA); Zahrah Marhoon, Dhahran (SA); Abdullah Atiyah, Dhahran (SA); Ahmed Bukhamseen, Dhahran (SA); Thomas Heinold, Dhahran (SA); Peter Egbe, Dhahran (SA); Alessandro Gallelli, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/405,571

(22) Filed: Jan. 5, 2024

(51) Int. Cl.
*E21B 33/14* (2006.01)
*E21B 33/16* (2006.01)
*E21B 36/04* (2006.01)

(52) U.S. Cl.
CPC ..... *E21B 33/16* (2013.01)

(58) Field of Classification Search
CPC ..... E21B 33/12; E21B 33/13; E21B 33/134; E21B 33/1208; E21B 33/14; E21B 36/00; E21B 36/04; E21B 29/10
See application file for complete search history.

(56) References Cited

U.S. PATENT DOCUMENTS

| | | | | |
|---|---|---|---|---|
| 7,857,052 | B2 | 12/2010 | Giroux et al. | |
| 11,536,111 | B2 * | 12/2022 | Carragher | E21B 36/00 |
| 2017/0226819 | A1 * | 8/2017 | Carragher | E21B 17/042 |
| 2018/0058175 | A1 * | 3/2018 | Mullen, II | E21B 33/14 |
| 2019/0153810 | A1 * | 5/2019 | Cervo | E21B 33/14 |
| 2019/0195062 | A1 * | 6/2019 | Espe | E21B 36/00 |
| 2020/0056444 | A1 * | 2/2020 | Benzie | E21B 33/1204 |
| 2020/0248526 | A1 * | 8/2020 | Carragher | E21B 33/12 |
| 2022/0178224 | A1 * | 6/2022 | Egbe | E21B 33/146 |
| 2022/0403711 | A1 * | 12/2022 | Louden | E21B 36/00 |
| 2022/0412178 | A1 * | 12/2022 | Godøy | E21B 33/13 |
| 2023/0160277 | A1 * | 5/2023 | Rege | E21B 43/1193 166/192 |
| 2024/0141754 | A1 * | 5/2024 | Mitchell | E21B 17/00 |

FOREIGN PATENT DOCUMENTS

WO 2018075097 A1 4/2018

* cited by examiner

*Primary Examiner* — Kipp C Wallace

(74) *Attorney, Agent, or Firm* — Vorys, Sater, Seymour and Pease LLP

(57) ABSTRACT

A method includes running a eutectic alloy system downhole in a wellbore including a first casing string and a second casing string therein, activating a differential valve tool within the second casing to generate a primary annular seal within a casing-casing annulus defined between the first casing string and second casing string, pumping a flushing fluid into the casing-casing annulus above the primary annular seal via a first ported collar, melting a eutectic alloy blanket into a molten alloy within the flushing fluid in the casing-casing annulus via a heater, solidifying the molten alloy to establish a supplemental seal above the primary annular seal in the casing-casing annulus between the first casing string and second casing string, and pumping cement into the casing-casing annulus above the supplemental seal to form a cement column in the casing-casing annulus via a second ported collar.

20 Claims, 7 Drawing Sheets

EUTECTIC ALLOY SYSTEM FOR CASING-CASING ANNULUS CEMENT REPAIR

FIELD OF THE DISCLOSURE

The present disclosure relates generally to wellbore cement repair and, more particularly, to methods and systems for wellbore cement repair using eutectic alloy packers.

BACKGROUND OF THE DISCLOSURE

Oil and gas wellbores are commonly drilled in a series of progressively smaller casings until reaching a desired depth. A wellbore drilling operation may begin with drilling into a formation to a specified depth for a first casing string, also known as a first "casing depth". The first casing string may be run downhole to the first casing depth and cemented in place by pumping cement between the formation and the first casing string to form a first stage cement column. The operation may continue with drilling to a second casing depth and running a second casing string downhole through the first casing string. The second casing string may then be cemented in place with a second stage cement column formed by pumping cement upward between the second casing string and the formation and continuing upward through a "casing-casing annulus" defined between the first casing string and the second casing string. The operation may continue with subsequent drilling and cementing stages until reaching a desired wellbore depth.

During this wellbore drilling operation, the cementing of casing strings may not provide complete isolation due to geological features such as "lost-circulation zones" where cement may escape into the formation rather than being pumped into the casing-casing annulus. Other isolation failures may arise due to cement composition issues, micro-annuli development during cement solidification, or post-set cement shrinkage. Any failure of isolation may enable wellbore fluids to flow upwards through the casing-casing annulus, which may adversely affect wellbore integrity and render the wellbore inoperable.

To avoid costly workover operations on wellbores with a loss of isolation, methods have been developed to restore integrity and correct failed cementing areas across lost-circulation zones downhole. These conventional methods include deploying a differential valve (DV) tool to help form a primary seal in the casing-casing annulus, and forming a supplemental seal by installing cement atop the DV tool. However, the cement itself may form cracks, or micro-cracks, due to temperature and stress cycling during the lifetime of the wellbore. Also, since the DV tool may be set with a high concentration of solids in the casing-casing annulus, the primary seal established between the DV tool and the first casing string may be compromised. Further, rubber gaskets commonly utilized by DV tools for sealing against the casing strings are subject to wear, corrosion, and erosion during operation of the wellbore. Thus, the conventional methods of correcting lost-circulation zones are susceptible to failure during a wellbore's lifetime, which may prompt further corrective measures or abandonment of the wellbore.

Accordingly, methods and systems are desired for correcting lost-circulation zones downhole with further leak barriers and a generally solids-free environment.

SUMMARY OF THE DISCLOSURE

Various details of the present disclosure are hereinafter summarized to provide a basic understanding. This summary is not an exhaustive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the present disclosure, a eutectic alloy system includes a sealing assembly, including a differential valve tool within a casing-casing annulus defined in a wellbore between a first casing string and a second casing string therein, the differential valve tool operable to establish a primary annular seal across the casing-casing annulus, a first ported collar positioned above the differential valve tool in the wellbore and operable to establish fluid communication between an interior of the second casing string and the casing-casing annulus, a eutectic alloy blanket positioned above the differential valve tool in the casing-casing annulus in the wellbore, and a second ported collar positioned proximal to the eutectic alloy blanket in the wellbore and operable establish fluid communication between the interior of the second casing string and the casing-casing annulus. The eutectic alloy system further includes a source of a flushing fluid in selective fluid communication with the first ported collar through the interior of the second casing string, a heater selectively operable to melt the eutectic alloy blanket and thereby permit the eutectic alloy blanket to form a secondary seal in the casing-casing annulus above the primary annular seal upon solidification, and a source of cement in selective fluid communication with the second ported collar through the interior of the second casing string.

In another embodiment, a method includes running a eutectic alloy system downhole in a wellbore including a first casing string and a second casing string therein, activating a differential valve tool within the second casing to generate a primary annular seal within a casing-casing annulus defined between the first casing string and second casing string, pumping a flushing fluid into the casing-casing annulus above the primary annular seal via a first ported collar, melting a eutectic alloy blanket into a molten alloy within the flushing fluid in the casing-casing annulus via a heater, solidifying the molten alloy to establish a supplemental seal above the primary annular seal in the casing-casing annulus between the first casing string and second casing string, and pumping cement into the casing-casing annulus above the supplemental seal to form a cement column in the casing-casing annulus via a second ported collar.

In a further embodiment, a wellbore cement repair system includes a first casing string cemented into a wall at a first depth of a wellbore, a second casing string run within the first casing string to form a casing-casing annulus and partially cemented at a further depth of the wellbore, a differential valve tool within the casing-casing annulus and operable to establish a primary annular seal across the casing-casing annulus, a first ported collar positioned above the differential valve tool in the wellbore and operable to establish fluid communication between an interior of the second casing string and the casing-casing annulus, a eutectic alloy blanket positioned above the differential valve tool in the casing-casing annulus in the wellbore, and a second ported collar positioned proximal to the eutectic alloy blanket in the wellbore and operable establish fluid communication between the interior of the second casing string and the casing-casing annulus The wellbore cement repair system further includes a source of a flushing fluid in selective fluid communication with the first ported collar through the interior of the second casing string, a heater selectively operable to melt the eutectic alloy blanket and thereby permit the eutectic alloy blanket to form a secondary seal in the casing-casing annulus above the primary annular seal upon solidification, and a source of cement in selective fluid communication with the second ported collar through the interior of the second casing string.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1:
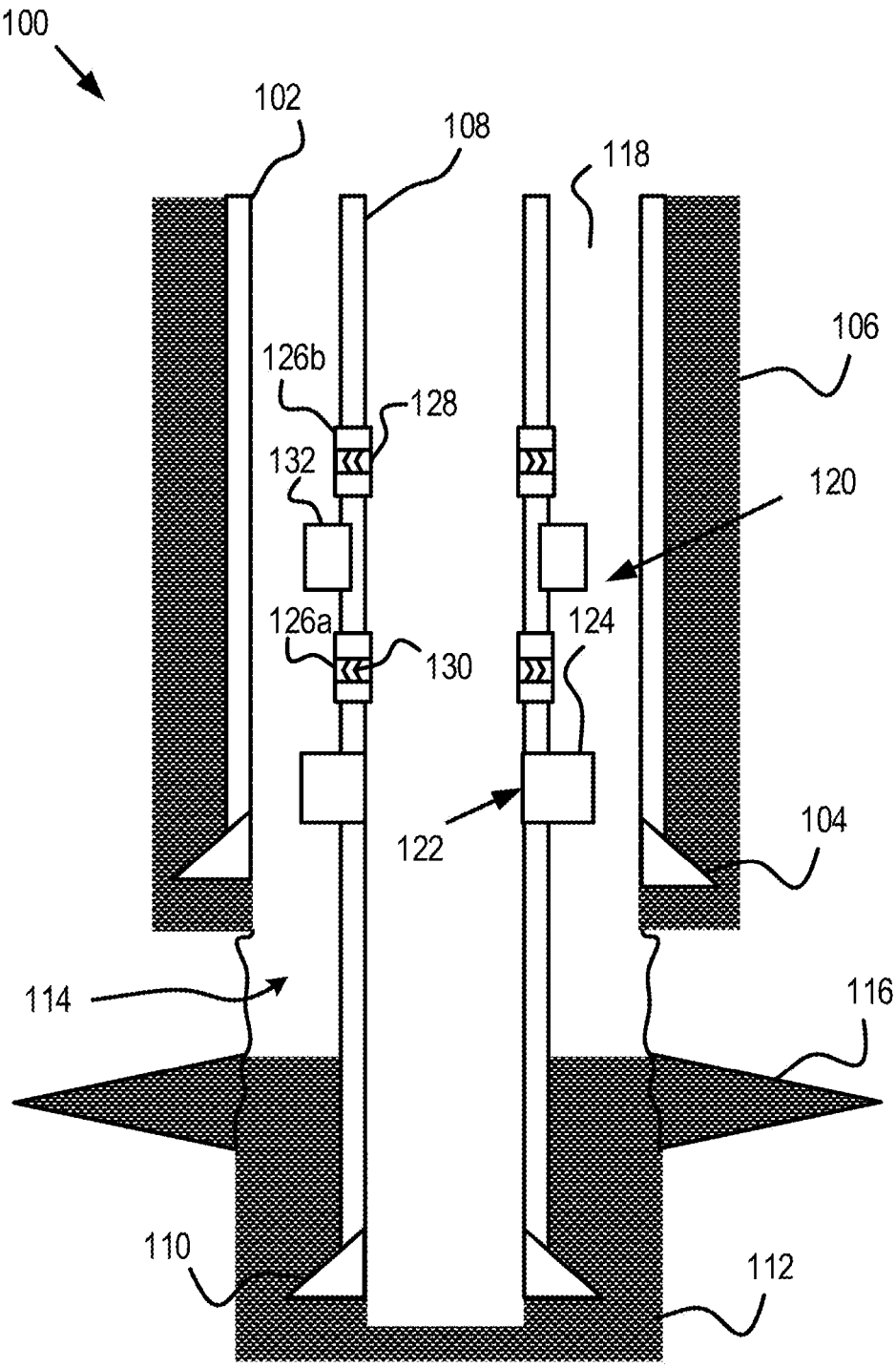
FIG. 1 is a schematic cross-sectional side view of a wellbore with a failed cementing area within a casing-casing annulus, according to one or more embodiments of the present disclosure.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

Embodiments in accordance with the present disclosure generally relate to wellbore cement repair and, more particularly, to methods and systems for using eutectic alloy packers in wellbore cement repair. The embodiments disclosed herein include establishing a primary seal in a casing-casing annulus with a differential valve tool, melting a blanket of eutectic alloy atop the primary seal, solidifying molten eutectic alloy to form a further gas-tight seal with corrosion resistance, and cementing the casing-casing annulus above the further seal. The embodiments may further include systems and methods for flushing the casing-casing annulus with a flushing fluid prior to forming the further seal. The flushing of the casing-casing annulus may remove any solids or debris therein, and may enable enhanced sealing capabilities without impurities. The eutectic alloy may provide a longer lifetime than traditional downhole packers, with greater corrosion resistance and a gas-tight interference fit seal, and may be deployed without erosion. Accordingly, using a eutectic alloy packer within a generally solids-free environment may enable superior performance and reliability when compared to conventional repair operations.

FIG. 1 is a schematic cross-sectional side view of a wellbore 100 with a failed cementing area within a casing-casing annulus, according to one or more embodiments of the present disclosure. The wellbore 100 may include a first casing string 102 that has been cemented into the wellbore 100. The first casing string 102 may terminate in a first shoe 104 to aid in seating the first casing string 102 in a level orientation. The first casing string 102 and the first shoe 104 may be cemented into the wellbore 100 with a first stage cement column 106, which may be introduced to finish and seal the first stage of the wellbore 100. The wellbore 100 may further include a second casing string 108 and second casing shoe 110 which may be run through the first casing string 102 to an increased depth, following further drilling operations. In some embodiments, the first casing string 102 is an outer casing string and the second casing string 108 is an inner casing string, such that further casing strings may be radially included outside of first casing string 102 or inside of second casing string 108 without departing from the scope of this disclosure.

During the construction of the wellbore 100, the second casing string 108 and second casing shoe 110 may be similarly cemented downhole to finish and seal the second stage of the wellbore 100. However, as shown in FIG. 1, a failed second stage cement column 112 is included—only partially cementing in the second casing string 108 and second casing shoe 110. Due to geological features, cement composition issues, or problems during cement solidification or curing, a failed cementing area 114 was generated during the introduction of the failed second stage cement column 112. The failed cementing area 114 may have been caused in part by a lost-circulation zone 116 into the wellbore 100. The lost-circulation zone 116 may enable cement of the failed cementing area 114 to flow away from the wellbore 100, rather than up into a casing-casing annulus 118 to complete the failed second stage cement column 112. With a failed cementing area 114, the open casing-casing annulus 118 may enable undesired flow of fluids to the surface of the wellbore 100. This undesired flow through the casing-casing annulus 118 may generate a sustained-casing pressure, which can prompt expensive workover operations and may render the wellbore 100 unusable.

The second casing string 108, as shown, may include a sealing assembly 120 included therein for remediation of the failed cementing area 114 downhole. The sealing assembly 120 may include a differential valve (DV) tool 122 coupled within the second casing string 108 for providing a primary seal within the casing-casing annulus 118. The DV tool 122 may include an annular seal member 124 that is selectively expandable in a radial direction to engage an interior of the first casing string 102 and to form a seal therewith. As illustrated, the annular seal member 124 is fluidly coupled to the interior of the second casing string 108 such that the annular seal member 124 expands outward into the casing-casing annulus 118 when subjected to a higher pressure from within the second casing string 108 rather than from within the casing-casing annulus 118. The annular seal member 124 may be constructed as a hydraulically or pneumatically activated packer including a rubber gasket.

The sealing assembly 120 may further include a plurality of ported collars 126*a,b* coupled in the second casing string above the DV tool 122. The plurality of ported collars 126*a,b* may provide selective fluid communication between the sealing assembly 120 (e.g., the interior of the second casing string 108) and the casing-casing annulus 118 for performing a cement repair operation on the wellbore 100. In some embodiments, the plurality of ported collars 126*a,b* may each include one or more ports 128 included therein to establish fluid communication through the second casing string 108. The plurality of ported collars may each include one or more rupture disks 130 within each port 128 and which may be selectively burst (ruptured) to enable fluid flow through the ports 128.

The sealing assembly 120 may further include a eutectic alloy blanket 132, which may be positioned within the casing-casing annulus 118 above the first ported collar 126*a*. In some embodiments, the eutectic alloy blanket 132 may be secured around the second casing string 108. As discussed above, eutectic alloys, such as bismuth-based alloys, may advantageously include low viscosity liquid states and may expand when solidifying.

Figure 2:
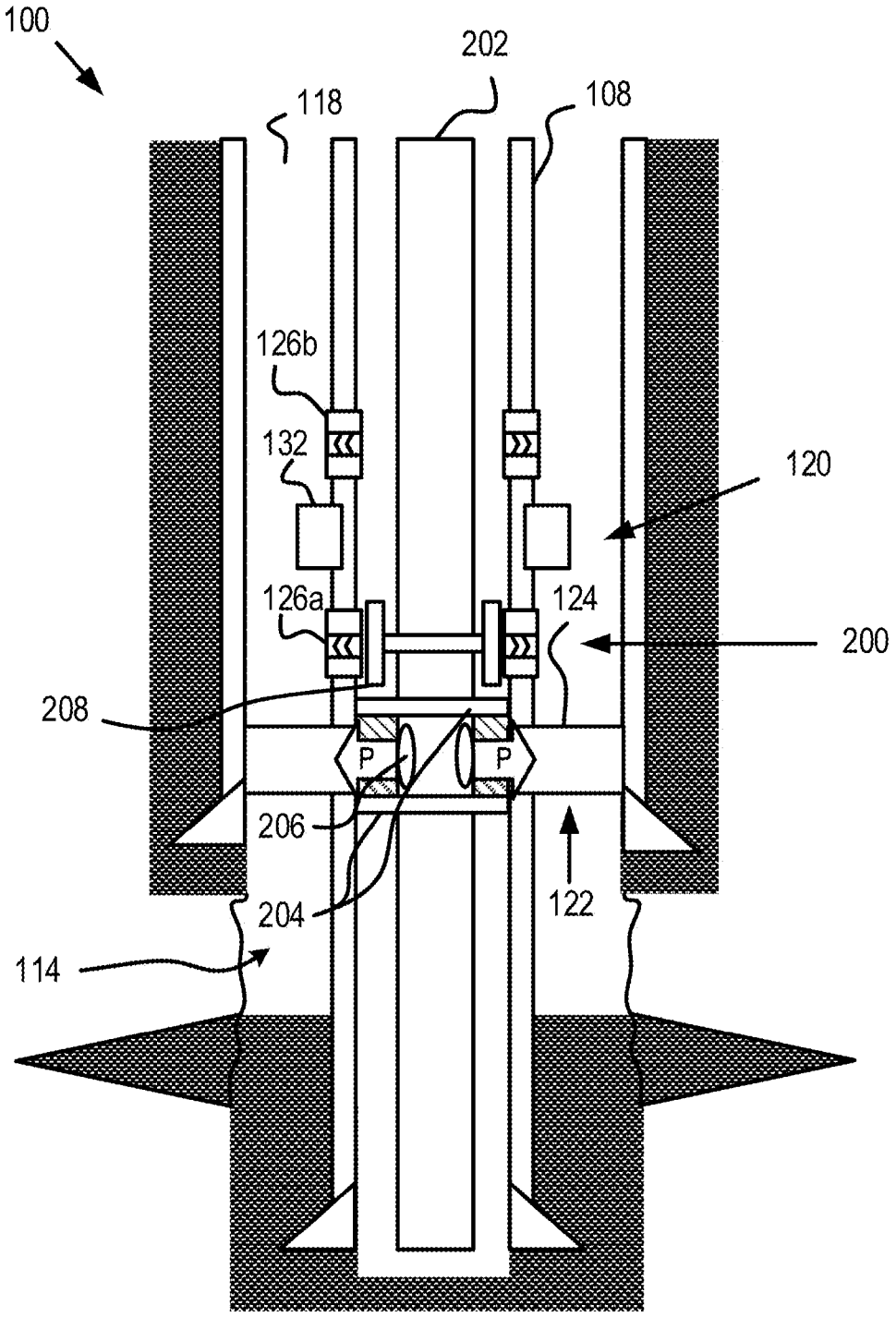
FIG. 2 is a schematic cross-sectional side view of the wellbore with a eutectic alloy system inserted therein for correction of the failed cementing area, according to one or more embodiments of the present disclosure.

FIG. 2 is a schematic cross-sectional side view of the wellbore 100 with a eutectic alloy system 200 deployed therein, according to one or more embodiments of the present disclosure. The eutectic alloy system 200 may include both the sealing assembly 120 and a tool string 202 inserted within the second casing string 108 for actuation of the sealing assembly 120. The tool string 202 may be run to the failed cementing area 114 and positioned near one or more components of the sealing assembly 120.

As one or more members of the sealing assembly 120 may be pneumatically or hydraulically driven, the tool string 200 may include a plurality of pressure cups 204 thereon. The pressure cups 204 may be selectively and radially extendable seals which may be deployed to isolate a portion of the interior of the second casing string 108 around the tool string 202. The location at which the pressure cups 204 are installed onto the tool string 202 may further include one or more valves 206. The valves 206 may be operable to establish fluid communication between the tool string 202 and the isolated section between the pressure cups 204 during operation. The pressure cups 204 may seat around one or more of the DV tool 122 and the ported collars 126 to provide actuation or fluid communication therethrough.

The tool string 202 may further include a heater 208 disposed thereon or forming part thereof. In operation, the heater 208 may be configured to melt the eutectic alloy blanket 132. In some embodiments, the heater 208 may be an electric resistance heater electrically coupled to a cable extending along the tool string 202. In further embodiments, the heater 208 may be operable to initiate a chemical reaction to selectively provide the heat for melting the eutectic alloy blanket 132 (e.g., a thermite reaction).

In some embodiments the tool string 202 may be a drilling string, however, those skilled in the art will readily appreciate that any string that may accommodate the pressure cups 204 and heater 208 may be utilized as tool string 202, without departing from the scope of this disclosure. The tool string 202 may be in fluid communication with a surface location, such that fluid and pressure may be provided from one or more external locations (e.g., first external location 302 of FIG. 3) through the tool string 202 to the sealing assembly 120 for actuation of one or more components. During operation, any translation of the tool string 202 may accordingly translate the pressure cups 204 and the heater 208. Thus, the tool string 202 may be selectively translated within the interior of the second casing string 108 to align the pressure cups 204 and/or heater 208 with one or more components of the sealing assembly 120.

Example operation of the eutectic alloy system 200 will now be provided with reference to FIGS. 2-5, which depict a series of cross-sectional side views of the wellbore 100, according to one or more embodiments. As shown in FIG. 2, the tool string 202 is positioned such that the pressure cups 204 are in place above and below the DV tool 122. The pressure cups 204 may form seals with the interior of the second casing string 108, and may facilitate the introduction of fluids to the DV tool 122. With the pressure cups 204 in place, fluids pumped down the tool string 202 may apply a pressure "P" to the DV tool 122. The pressure "P" may hydraulically or pneumatically activate annular seal member 124 of the DV tool 122 to seal the casing-casing annulus 118 within the failed cementing area 114. In other embodiments, rather than employing the pressure cups 204 and tool string 202, the DV tool 122 may be activated by seating a plug (not shown) in the second casing string 108 below the DV tool and pressurizing the interior of the second casing string 108 to expand the annular seal member 124.

Figure 3A:
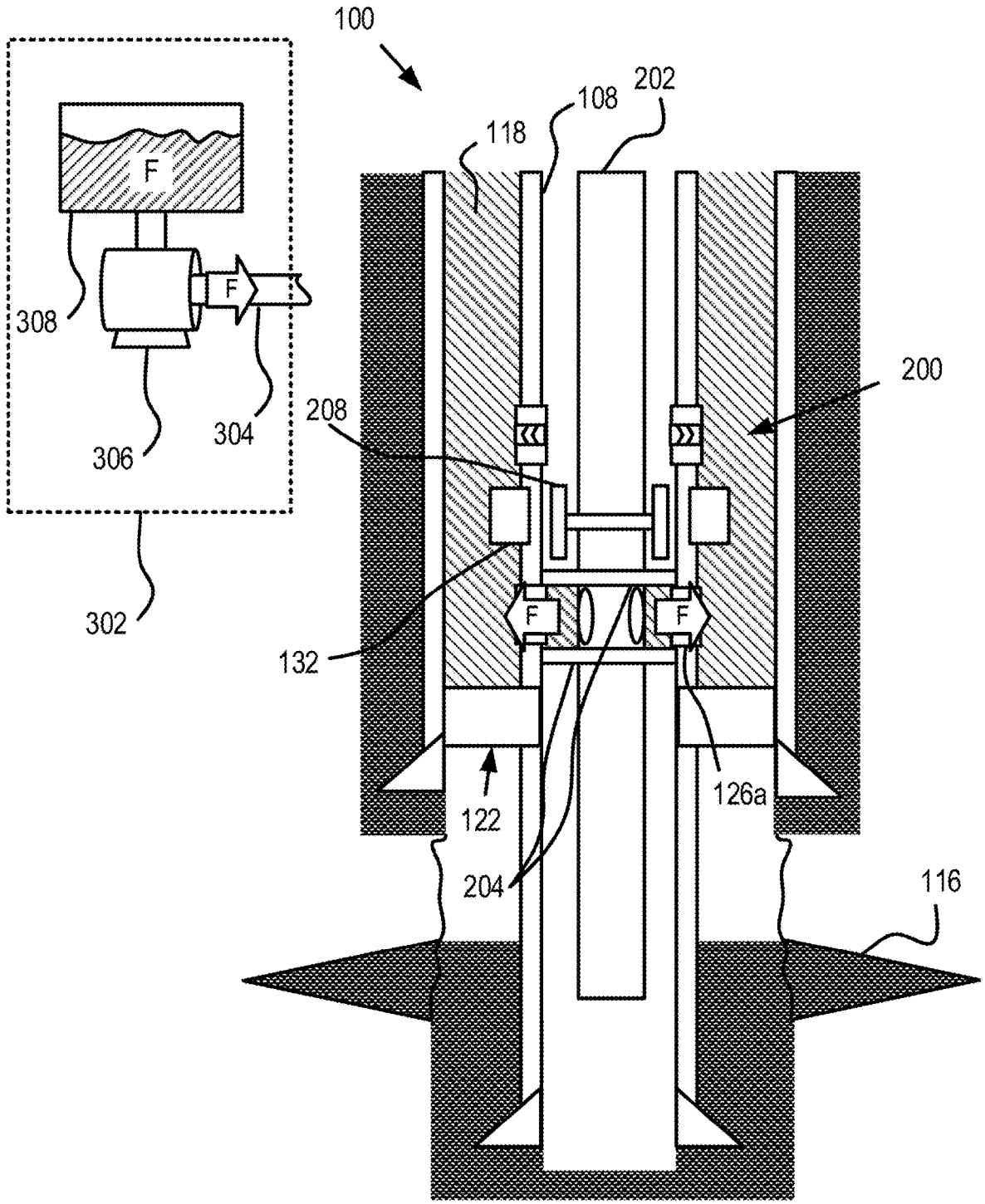
FIG. 3A is a schematic cross-sectional side view of the wellbore during a flushing of the casing-casing annulus, according to one or more embodiments of the present disclosure.

FIG. 3A is a schematic cross-sectional side view of the wellbore 100 as the casing-casing annulus 118 is flushed with a fluid "F," according to one or more embodiments of the present disclosure. The DV tool 122 may be maintained in a deployed state, such that the DV tool 122 has generated a primary seal within the casing-casing annulus 118. With the first seal in place via the DV tool 122, an initial isolation of the lost-circulation zone 116 is implemented and further operations may occur within the casing-casing annulus 118.

Following application of the pressure "P" to the DV tool 122, the pressure cups 204 may be unseated from around the DV tool 122, and retracted upward in the wellbore 100. In some embodiments, the tool string 202 may be retracted from the wellbore 100, such that the pressure cups 204 mounted thereon are similarly retracted within the second casing string 108. The pressure cups 204 may be repositioned to straddle the first ported collar 126*a*. A flushing fluid "F" may be pumped down the tool string 202 to apply pressure sufficient to rupture the rupture disk 130 (FIG. 1) in first ported collar 126*a*. Rupturing the rupture disk 130 within the first ported collar 126*a* may place the casing-casing annulus 118 in fluid communication with the tool string 202.

Once the casing-casing annulus 118 is in fluid communication with the tool string 202, the flushing fluid "F" may be provided through the first ported collar 126*a* above the DV tool 122. The flushing fluid "F" may be a generally solids-free fluid which can flush the casing-casing annulus 118 of any drilling mud or debris. The flushing fluid "F" may include water, brines (chlorides, bromides, formats, etc.), completion fluids, or other suitable fluids for removing solids and debris from the casing-casing annulus 118. The flushing of the casing-casing annulus 118 may remove any solids or debris normally found in the casing-casing annulus 118 during a wellbore cement repair process that might impede the formation of an annular seal across the casing-casing annulus 118. Removal of the solids or debris may thus enable increased sealing potential within the casing-casing annulus 118 by establishing a clean environment in which further seals may be effectively formed.

As shown in FIG. 3A, the flushing fluid "F" may be stored at a first external location 302 until it is to be pumped into the wellbore 100. A fluid line 304 may provide fluid communication between a pump 306 and the tool string 202. The pump 306 may provide pressure to the fluid line 304 to further assist in flushing of the casing-casing annulus 118, such that pressurized fluid may enter and displace any solids or other debris. In some embodiments, the pump 306 is in fluid communication with a reservoir 308, which may be a fluid tank, repurposed wellbore, or other fluid container for storing fluid "F".

Once the casing-casing annulus 118 is sufficiently flushed of any solids or debris, a plug (not shown) or closing sleeve 404 (FIG. 4) may be set or actuated within the first ported collar 126*a* to prevent any backflow of the flushing fluid "F" from the casing-casing annulus 118. As the first ported collar 126*a* is plugged, the heater 208 may be activated adjacent the eutectic alloy blanket 132. The heater 208 may begin to provide heat to the eutectic alloy blanket 132 to begin a melting process in the flushed environment of the casing-casing annulus 118. As discussed above, eutectic alloys may require little heat to activate and begin melting. As such, the heater 208 may rapidly melt the eutectic alloy blanket 132, and molten alloy may drip away from the eutectic alloy blanket 132. The heater 208 may not directly contact the eutectic alloy blanket 132, but may use radiative or conductive heating through the second casing string 108 to melt the eutectic alloy blanket 132. The molten alloy may travel through the generally solids-free environment to any position above or around the DV tool 122. As the molten alloy drips downward, it may begin to coalesce and solidify within the casing-casing annulus 118. The eutectic alloy expands upon solidification, thus increasing any space occupied by the material from the eutectic alloy blanket 132 and forming a supplemental seal across the casing-casing annulus 118. The supplemental seal formed by the eutectic alloy blanket 132 may exhibit a greater corrosion resistance than the rubber gasket in of the DV tool 122.

Figure 3B:
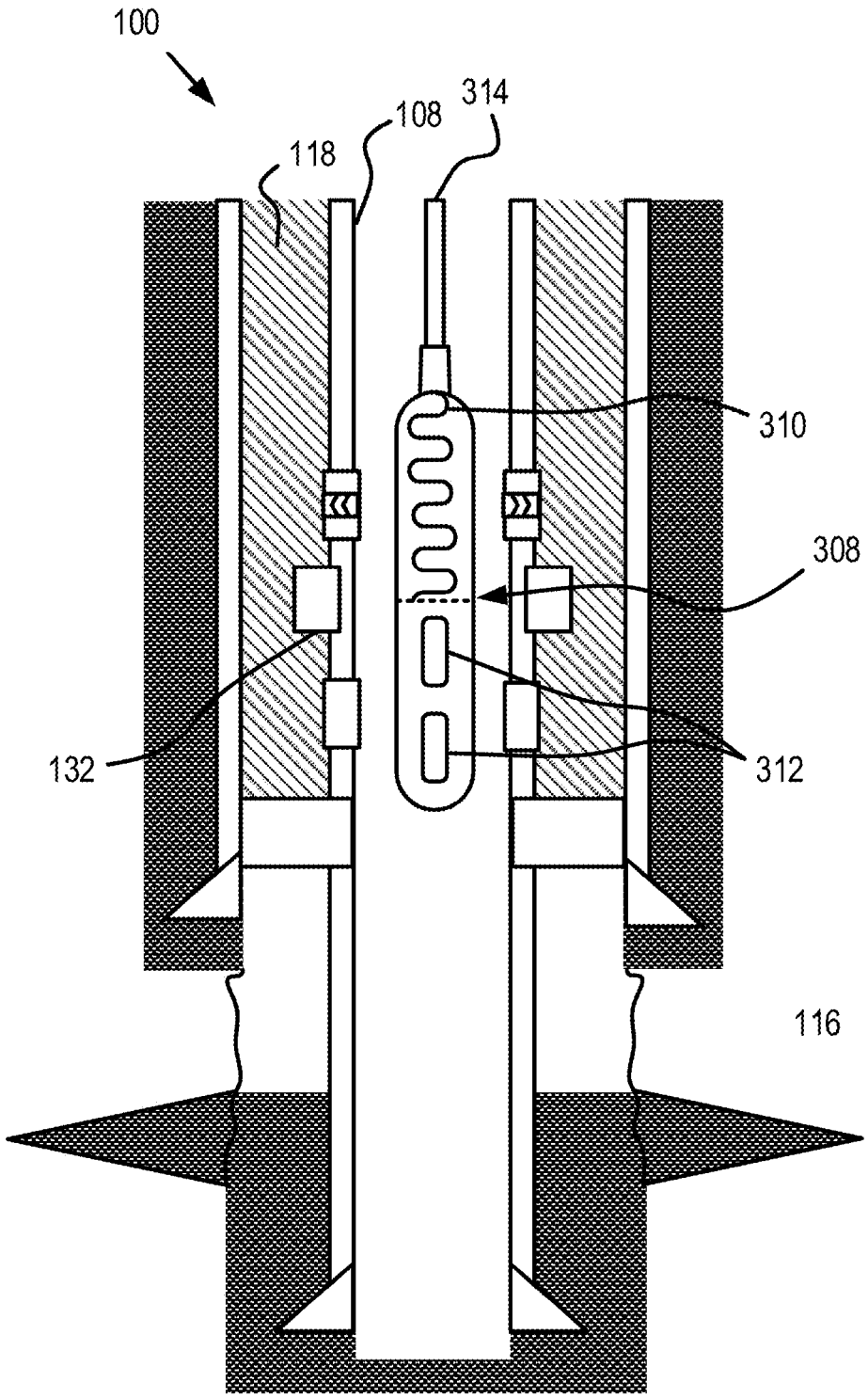
FIG. 3B is a schematic cross-sectional side view of the wellbore with an alternate heater included therein, according to one or more embodiments of the present disclosure.

FIG. 3B is a schematic cross-sectional side view of the wellbore 100 with an alternate heater 308 included therein, according to one or more embodiments of the present disclosure. In the illustrated embodiment, during the process of heating the eutectic alloy blanket 132, the tool string 202 may be retracted out of the wellbore 100. In place of the tool string 202, an alternate heater 308 may be advanced downhole within the second casing string 108 to the location of the eutectic alloy blanket 132. The alternate heater 308 may be a singular heating tool including either an electrically-operated heating element 310, or one or more reactive components 312 for generating an exothermic reaction. The alternate heater 308 may be run via a heater line 314 which may be electrically charged. In the illustrated embodiment, following sufficient melting of the eutectic alloy blanket 132 or after a pre-determined amount of time, the alternate heater 308 may be retracted out of the wellbore 100 and the tool string 202 may be reinserted therein.

Figure 4:
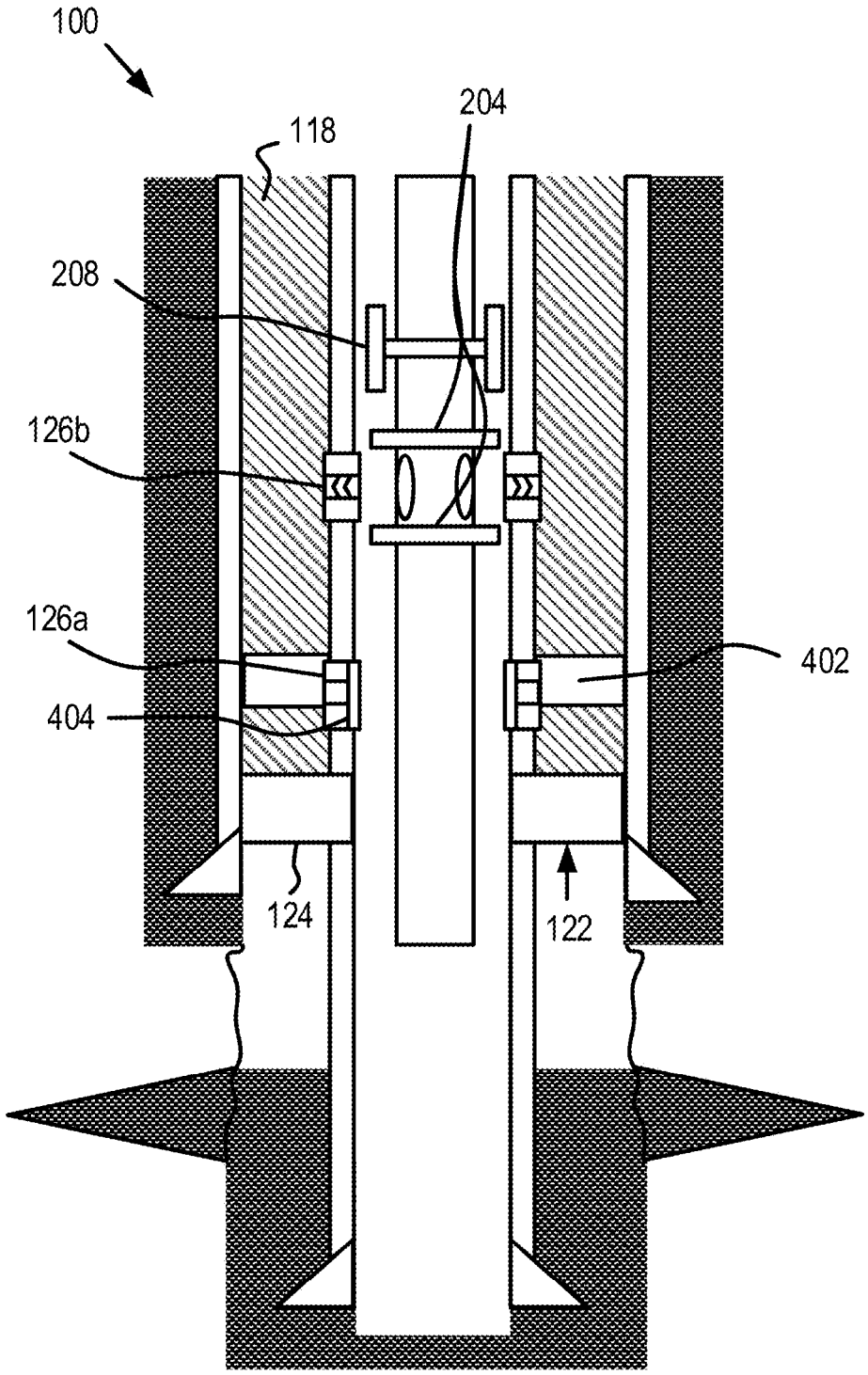
FIG. 4 is a schematic cross-sectional side view of the wellbore with a solidified eutectic packer within the casing-casing annulus, according to one or more embodiments of the present disclosure.

FIG. 4 is a schematic cross-sectional side view of the wellbore 100 with a solidified eutectic packer 402 within the casing-casing annulus 118, according to one or more embodiments of the present disclosure. The solidified eutectic packer 402 may include most or all material of the eutectic alloy blanket 132 (FIGS. 1-3), and may form a gas-tight seal within the casing-casing annulus 118. In some embodiments, the solidified eutectic packer 402 may form within 6-16 inches of the initial location of the eutectic alloy blanket 132. However, in these embodiments, the location of the solidified eutectic packer may be shifted one or more inches up or down based upon flow speeds, temperature of the flushing fluid "F", and pressure within the casing-casing annulus 118. Further, as discussed above, the first ported collar 126*a* may be seen with a closing sleeve 404 activated therein. Prior to relocation of the pressure cups 204 from the first ported collar 126*a*, an increased pressure may be applied between the pressure cups 204 to actuate a closing sleeve 404 and seal the first ported collar 126*a*. In alternate embodiments, as discussed above, one or more plugs (not shown) may be introduced to achieve a similar effect.

Within the flushed environment generally free of any solids or debris, the solidified eutectic packer 402 may be formed without imperfections or voids that would frustrate the supplemental seal. Further, the solidified eutectic packer 402 may possess corrosive resistance superior to the DV tool 122 and annular seal member 124, or other conventional packing means. The solidified eutectic packer 402 may further possess a long-term operational span without any need for maintenance or replacement. Through the molten deployment of the solidified eutectic packer 402, any erosion may have occurred to the eutectic alloy blanket 132 during running into the wellbore 100 on the second casing string 108, will be corrected, further increasing reliability and lifetime.

Figure 5:
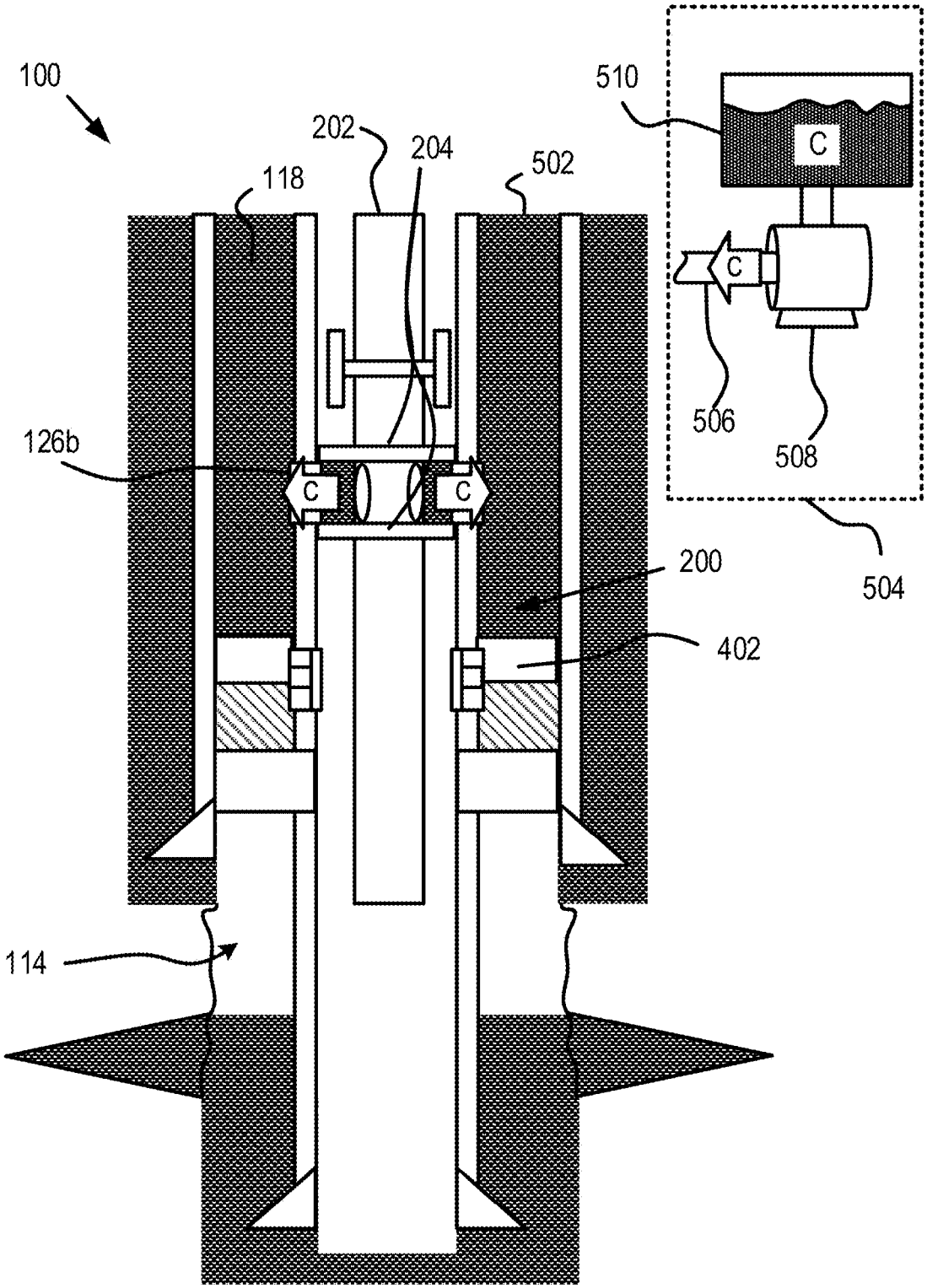
FIG. 5 is a schematic cross-sectional side view of the wellbore with a completed cement repair, according to one or more embodiments of the present disclosure

FIG. 5 is a schematic cross-sectional side view of the wellbore 100 with a completed repair operation, according to one or more embodiments of the present disclosure. Following solidification of the solidified eutectic packer 402, the pressure cups 204 may be seated across the second ported collar 126*b*. As discussed above, the pressure cups 204 facilitate fluid communication between tool string 202 and the casing-casing annulus 118.

Once fluid communication is established, cement "C" may be provided through the second ported collar 126*b* and into the casing-casing annulus 118. As the cement "C" is introduced to the casing-casing annulus 118, a second stage cement column 502 is established atop the solidified eutectic packer 402. As shown in FIG. 5, the cement "C" may be stored at a second external location 504 until it is to be pumped into the wellbore 100. A cement line 506 may provide fluid communication between a cement pump 508 and the tool string 202. The cement pump 508 may provide pressure to the cement line 506 to further assist in inserting the cement "C" into the casing-casing annulus 118. In some embodiments, the cement pump 508 is in fluid communication with a cement reservoir 510, which may be a fluid tank, repurposed wellbore, or other fluid container for storing cement "C".

The second stage cement column 502 may prevent the flow of any wellbore fluids through the casing-casing annulus 118 above the lost-circulation zone 116. Further, as discussed above, the solidified eutectic packer 402 may provide a superior seal, corrosion resistance, and lifetime compared to conventional packers or the DV tool 122 alone. Accordingly, the second stage cement column 502 may be further protected by the solidified eutectic packer 402 to prevent sustained casing pressure and expensive workovers or downtime.

Figure 6:
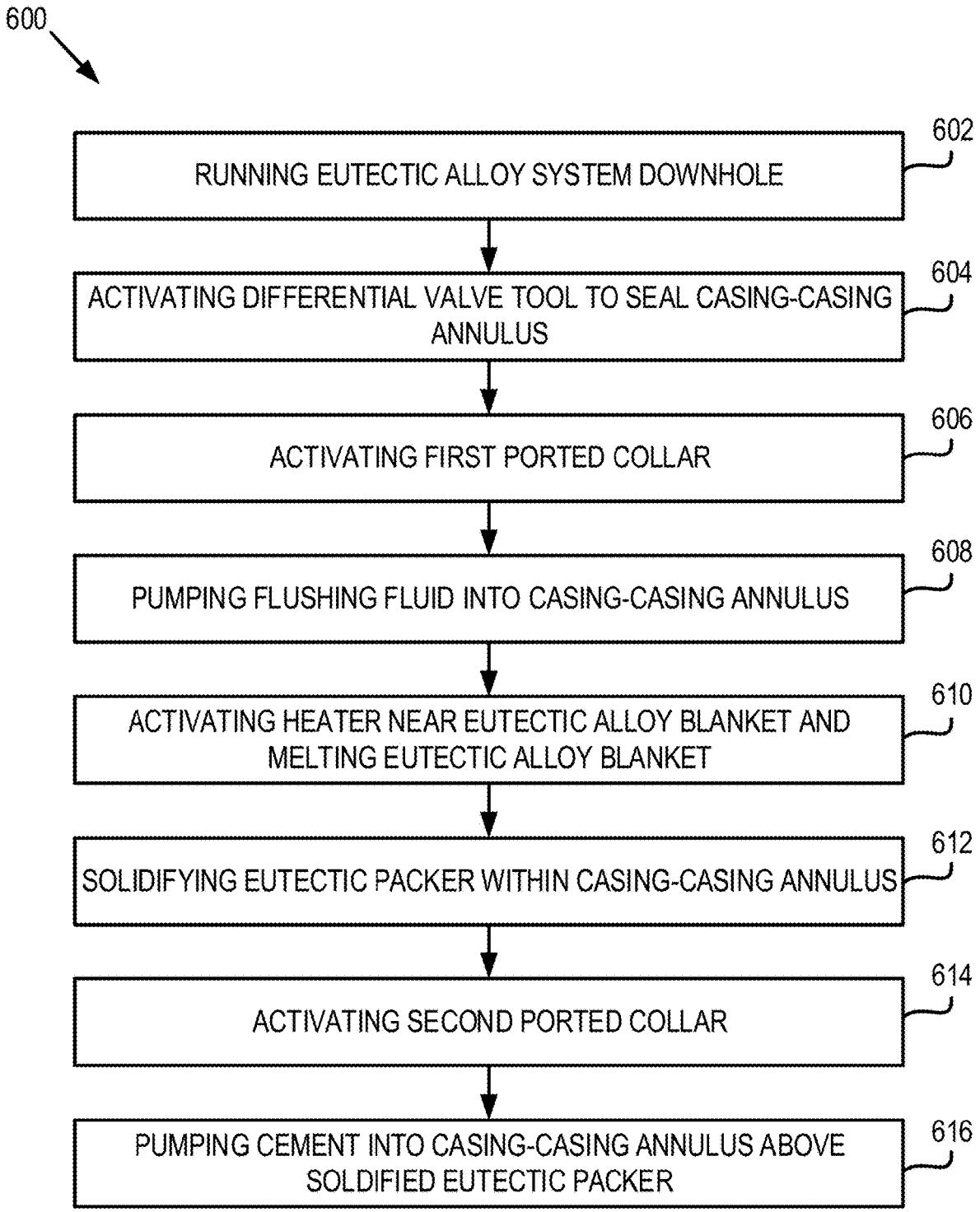
FIG. 6 is a schematic flowchart of an example method for performing a cement repair with eutectic alloy system.

FIG. 6 is a schematic flowchart of an example method 600 for performing a wellbore cement repair, e.g., repairing a failed cementing area (e.g., failed cementing area 114 caused by a lost-circulation zone (e.g., the lost-circulation zone 116) with a eutectic alloy system (e.g., the eutectic alloy system 200). The method 600 may begin at 602 with running the eutectic alloy system downhole in a wellbore (e.g., the wellbore 100). A sealing assembly (e.g., the sealing assembly 120) of the eutectic alloy system may be run into the wellbore on a second casing string (e.g., the second casing string 108) within a first casing string (e.g., first casing string 102). For example, a DV tool (e.g., the DV tool 122), a eutectic alloy blanket (e.g., the eutectic alloy blanket 132), and a plurality of ported collars (e.g., the ported collars 126*a,b*) may be run into the wellbore on the second casing string. Cement may be pumped down the second casing string and up around the second casing string to cement the second casing string in the wellbore. If a lost-circulation zone (e.g., lost-circulation zone 116) prevents a cement column from forming in a casing-casing annulus (e.g., casing-casing annulus 118), portions of the eutectic alloy system may be run in on a tool string (e.g., the tool string 202) within the second casing string. For example, a heater (e.g., the heater 208) and a plurality of pressure cups (e.g., the pressure cups 204) may be run in on the tool string until reaching the vicinity of the DV tool.

The method 600 may continue at 604 with activating the DV tool to create a primary seal within a casing-casing annulus (e.g., the casing-casing annulus 118) of the wellbore. Activating the DV tool may include setting the pressure cups around the DV tool and applying a pressure (e.g., the pressure "P") therebetween. The applied pressure may hydraulically or pneumatically activate the DV tool and extend a packer therein to generate the primary seal. In some embodiments, the packer of the DV tool may include an annular seal member (e.g., annular seal member 124) for generating the primary seal for initial isolation of the casing-casing annulus from the formation.

The method 600 may continue at 606 with activation of a first ported collar (e.g., the first ported collar 126*a*) to enable fluid communication with between the tool string and the casing-casing annulus. In some embodiments, the first ported collar may include one or more rupture disks which hold one or more ports of the first ported collar closed. Activating the first ported collar may include setting the pressure cups around the first ported collar and applying a pressure to burst the rupture disks, or otherwise open the port therein. The pressure cups may be independently translated along the tool string, or may be operatively coupled to the tool string such that the tool string is retracted out of the hole to align the pressure cups with the first ported collar. The activation of the first ported collar may enable flow of a flushing fluid (e.g., flushing fluid "F") between the tool string, and the casing-casing annulus.

Accordingly, the method 600 may continue at 608 with pumping a flushing fluid (e.g., the flushing fluid "F") through the first ported collar and into the casing-casing annulus. The flushing fluid may flush out any solid or debris within the casing-casing annulus. Thus the flushing fluid may enable enhanced sealing within the casing-casing annulus without obstructions or impurities. Pumping the flushing fluid may be performed via a pump (e.g., the pump 306) located at an external location (e.g., the first external location 302). The pump at the external location may be in fluid communication with a reservoir (e.g., the reservoir 308) which stores and provide the flushing fluid to the pump. The pump may be in fluid communication with the tool string via a fluid line (e.g., the fluid line 304) at the external location.

The method 600 may continue at 610 with activating the heater adjacent the eutectic alloy blanket and beginning a heating process. The heater may utilize conduction, convection, or radiation to provide the heat necessary to begin melting of the eutectic alloy blanket. The eutectic alloy blanket may accordingly drip within the casing-casing annulus filled with the flushing fluid. The flushing fluid may provide an optimal environment for solidification of the molten eutectic alloy without impurities.

The method may continue at 612 with solidifying the molten eutectic alloy to form a solidified eutectic packer (e.g., the solidified eutectic packer 402). The solidified eutectic packer may be formed of the coalesced molten eutectic alloy within the casing-casing annulus. Accordingly, due to the eutectic nature of the alloy, the solidified eutectic packer may expand during solidification and may form a second gas-tight seal within the casing-casing annulus. The solidified eutectic packer may form at any location in the casing-casing annulus between the DV tool and the second ported collar (e.g., the second ported collar 126*b*).

The method may continue at 614 with activation of the second ported collar to enable further fluid communication with between the tool string and the casing-casing annulus above the solidified eutectic packer. Activating the second ported collar may include setting the pressure cups around the second ported collar and applying a pressure to burst or otherwise open the port therein. The method may continue at 616 with pumping cement into the casing-casing annulus above the solidified eutectic packer to define a second stage cement column (e.g., the second stage cement column 502). The repaired second stage cement may prevent the flow of any wellbore fluids through a failed cementing area (e.g., the failed cementing area 114) including the casing-casing annulus. Further, as discussed above, the solidified eutectic packer may provide a superior seal, corrosion resistance, and lifetime compared to conventional packers. Accordingly, the repaired second stage cement may be further protected by the solidified eutectic packer to prevent sustained casing pressure and expensive workovers or downtime.

Embodiments disclosed herein include:

A. A eutectic alloy system comprising: a sealing assembly including: a differential valve tool within a casing-casing annulus defined in a wellbore between a first casing string and a second casing string therein, the differential valve tool operable to establish a primary annular seal across the casing-casing annulus, a first ported collar positioned above the differential valve tool in the wellbore and operable to establish fluid communication between an interior of the second casing string and the casing-casing annulus, a eutectic alloy blanket positioned above the differential valve tool in the casing-casing annulus in the wellbore, and a second ported collar positioned proximal to the eutectic alloy blanket in the wellbore and operable establish fluid communication between the interior of the second casing string and the casing-casing annulus; a source of a flushing fluid in selective fluid communication with the first ported collar through the interior of the second casing string; a heater selectively operable to melt the eutectic alloy blanket and thereby permit the eutectic alloy blanket to form a secondary seal in the casing-casing annulus above the primary annular seal upon solidification; and a source of cement in selective fluid communication with the second ported collar through the interior of the second casing string.

B. A method comprising: running a eutectic alloy system downhole in a wellbore including a first casing string and a second casing string therein; activating a differential valve tool within the second casing to generate a primary annular seal within a casing-casing annulus defined between the first casing string and second casing string; pumping a flushing fluid into the casing-casing annulus above the primary annular seal via a first ported collar; melting a eutectic alloy blanket into a molten alloy within the flushing fluid in the casing-casing annulus via a heater; solidifying the molten alloy to establish a supplemental seal above the primary annular seal in the casing-casing annulus between the first casing string and second casing string; and pumping cement into the casing-casing annulus above the supplemental seal to form a cement column in the casing-casing annulus via a second ported collar.

C. A wellbore cement repair system comprising: a first casing string cemented into a wall at a first depth of a wellbore; a second casing string run within the first casing string to form a casing-casing annulus and partially cemented at a further depth of the wellbore; a differential valve tool within the casing-casing annulus and operable to establish a primary annular seal across the casing-casing annulus; a first ported collar positioned above the differential valve tool in the wellbore and operable to establish fluid communication between an interior of the second casing string and the casing-casing annulus; a eutectic alloy blanket positioned above the differential valve tool in the casing-casing annulus in the wellbore; a second ported collar positioned proximal to the eutectic alloy blanket in the wellbore and operable establish fluid communication between the interior of the second casing string and the casing-casing annulus; a source of a flushing fluid in selective fluid communication with the first ported collar through the interior of the second casing string; a heater selectively operable to melt the eutectic alloy blanket and thereby permit the eutectic alloy blanket to form a secondary seal in the casing-casing annulus above the primary annular seal upon solidification; and a source of cement in selective fluid communication with the second ported collar through the interior of the second casing string.

Each of embodiments A through C may have one or more of the following additional elements in any combination: Element 1: further comprising a tool string extendable within the interior of the second casing string, and wherein the source of flushing fluid and the source of cement are in selective fluid communication with the first and second ported collars through the tool string. Element 2: wherein the tool string includes a plurality of pressure cups operable to engage the second casing string on opposed sides of the differential valve tool, the first ported collar, the second ported collar, or a combination thereof. Element 3: wherein the heater is positioned on the tool string and utilizes conductive or radiative heating to melt the eutectic alloy blanket through the second casing string. Element 4: wherein the heater is extendable within the interior of the second casing string via a heater line, and wherein the heater includes an electrical or chemical heating component. Element 5: further comprising: a pump in fluid communication with the source of the flushing fluid and operable to pump the flushing fluid downhole; and a fluid line operable to receive the flushing fluid from the pump, wherein the fluid line is in fluid communication with the interior of the second casing string to supply the flushing fluid to the first ported collar. Element 6: wherein the eutectic alloy blanket includes a bismuth-based alloy. Element 7: wherein the differential valve tool includes a hydraulically or pneumatically activated packer to generate the primary annular seal. Element 8: wherein the hydraulically or pneumatically activated packer includes a rubber gasket, and wherein the eutectic alloy blanket includes a greater corrosion resistance than the rubber gasket.

Element 9: further comprising: pumping, via a pump at a first external location, the flushing fluid from a reservoir to a fluid line in fluid communication with second casing string. Element 10: further comprising: pumping, via a cement pump at a second external location, the cement from a cement reservoir to a cement line in fluid communication with the second casing string. Element 11: further comprising: running a tool string including the heater thereon within the second casing string to locate the heater at or near the eutectic alloy blanket. Element 12: further comprising: running a tool string including a plurality of pressure cups thereon and seatable around the differential valve tool; seating the plurality of pressure cups across the differential valve tool; applying a hydraulic or pneumatic pressure to the differential valve tool between the pressure cups; and actuating a packer within the differential valve tool to generate the primary annular seal. Element 13: further comprising: retracting the tool string to seat the plurality of pressure cups around the first ported collar; applying a hydraulic or pneumatic pressure to the first ported collar; and rupturing one or more rupture disks of the first ported collar to enable the flushing fluid to flow therethrough. Element 14: further comprising: retracting the tool string to seat the plurality of pressure cups around the second ported collar; applying a hydraulic or pneumatic pressure to the second ported collar; and rupturing one or more rupture disks of the second ported collar to enable the cement to flow therethrough. Element 15: further comprising a plurality of pressure cups within the second casing string and operable to seat around the differential valve tool, the first ported collar, the second ported collar, or a combination thereof such that a fluid may be introduced between the pressure cups to activate the differential valve tool, the first ported collar, the second ported collar, or the combination thereof. Element 16: further comprising a tool string within the second casing string and including the plurality of pressure cups thereon. Element 17: further comprising: a pump in fluid communication with the source of flushing fluid and operable to pump the flushing fluid downhole; and a fluid line operable to receive the flushing fluid from the pump, wherein the fluid line is in fluid communication with the second casing string to supply the flushing fluid to the first ported collar.

By way of non-limiting example, exemplary combinations applicable to A through C include: Element 1 with Element 2; Element 2 with Element 3; Element 2 with Element 4; Element 7 with Element 8; Element 12 with Element 13; Element 13 with Element 14; Element 16 with Element 17.

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation used herein are merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached"

or "attached to" may indicate establishing either a direct or indirect connection, and is not limited to either unless expressly referenced as such.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The invention claimed is:

1. A eutectic alloy system, comprising:

a sealing assembly including:

a differential valve tool within a casing-casing annulus defined in a wellbore between a first casing string and a second casing string extended within the wellbore, the differential valve tool being operable to establish a primary annular seal across the casing-casing annulus;

a first ported collar positioned above the differential valve tool in the wellbore and operable to establish fluid communication between an interior of the second casing string and the casing-casing annulus;

a eutectic alloy blanket positioned above the differential valve tool in the casing-casing annulus; and a second ported collar positioned proximal to the eutectic alloy blanket in the wellbore and operable to establish fluid communication between the interior of the second casing string and the casing-casing annulus;

a source of a flushing fluid in selective fluid communication with the first ported collar through the interior of the second casing string;

a heater selectively operable to melt the eutectic alloy blanket and thereby permit the eutectic alloy blanket to form a secondary seal in the casing-casing annulus above the primary annular seal upon solidification; and a source of cement in selective fluid communication with the second ported collar through the interior of the second casing string.

2. The eutectic alloy system of claim 1, further comprising a tool string extendable within the interior of the second casing string, wherein the source of flushing fluid and the source of cement are in selective fluid communication with the first and second ported collars through the tool string.

3. The eutectic alloy system of claim 2, wherein the tool string includes a plurality of pressure cups operable to engage the second casing string on opposed sides of the differential valve tool, the first ported collar, the second ported collar, or a combination thereof.

4. The eutectic alloy system of claim 3, wherein the heater is positioned on the tool string and utilizes conductive or radiative heating to melt the eutectic alloy blanket through the second casing string.

5. The eutectic alloy system of claim 3, wherein the heater is extendable within the interior of the second casing string via a heater line, and wherein the heater includes an electrical or chemical heating component.

6. The eutectic alloy system of claim 1, further comprising:

a pump in fluid communication with the source of the flushing fluid and operable to pump the flushing fluid downhole; and a fluid line operable to receive the flushing fluid from the pump, wherein the fluid line is in fluid communication with the interior of the second casing string to supply the flushing fluid to the first ported collar.

7. The eutectic alloy system of claim 1, wherein the eutectic alloy blanket includes a bismuth-based alloy.

8. The eutectic alloy system of claim 1, wherein the differential valve tool includes a hydraulically or pneumatically activated packer to generate the primary annular seal.

9. The eutectic alloy system of claim 8, wherein the hydraulically or pneumatically activated packer includes a rubber gasket, and wherein the eutectic alloy blanket includes a greater corrosion resistance than the rubber gasket.

10. A method, comprising:

running a eutectic alloy system into a wellbore including a first casing string and a second casing string arranged within the wellbore;

activating a differential valve tool within the second casing string and thereby generating a primary annular seal within a casing-casing annulus defined between the first and second casing strings;

pumping a flushing fluid into the casing-casing annulus above the primary annular seal via a first ported collar;

melting a eutectic alloy blanket into a molten alloy within the flushing fluid in the casing-casing annulus via a heater;

solidifying the molten alloy to establish a supplemental seal above the primary annular seal in the casing-casing annulus; and pumping cement into the casing-casing annulus above the supplemental seal to form a cement column in the casing-casing annulus via a second ported collar.

11. The method of claim 10, further comprising pumping, via a pump at a first external location, the flushing fluid from a reservoir to a fluid line in fluid communication with second casing string.

12. The method of claim 10, further comprising pumping, via a cement pump at a second external location, the cement from a cement reservoir to a cement line in fluid communication with the second casing string.

13. The method of claim 10, further comprising running a tool string including the heater thereon within the second casing string to locate the heater at or near the eutectic alloy blanket.

14. The method of claim 10, further comprising:

running a tool string including a plurality of pressure cups thereon and seatable around the differential valve tool;

seating the plurality of pressure cups across the differential valve tool;

applying a hydraulic or pneumatic pressure to the differential valve tool between the pressure cups; and actuating a packer within the differential valve tool to generate the primary annular seal.

15. The method of claim 14, further comprising:

retracting the tool string to seat the plurality of pressure cups around the first ported collar;

applying a hydraulic or pneumatic pressure to the first ported collar; and rupturing one or more rupture disks of the first ported collar to enable the flushing fluid to flow therethrough.

16. The method of claim 15, further comprising:

retracting the tool string to seat the plurality of pressure cups around the second ported collar;

applying a hydraulic or pneumatic pressure to the second ported collar; and rupturing one or more rupture disks of the second ported collar to enable the cement to flow therethrough.

17. A wellbore cement repair system, comprising:

a first casing string cemented into a wall at a first depth of a wellbore;

a second casing string run within the first casing string to form a casing-casing annulus and partially cemented at a further depth of the wellbore;

a differential valve tool within the casing-casing annulus and operable to establish a primary annular seal across the casing-casing annulus;

a first ported collar positioned above the differential valve tool in the wellbore and operable to establish fluid communication between an interior of the second casing string and the casing-casing annulus;

a eutectic alloy blanket positioned above the differential valve tool in the casing-casing annulus in the wellbore;

a second ported collar positioned proximal to the eutectic alloy blanket in the wellbore and operable establish fluid communication between the interior of the second casing string and the casing-casing annulus;

a source of a flushing fluid in selective fluid communication with the first ported collar through the interior of the second casing string;

a heater selectively operable to melt the eutectic alloy blanket and thereby permit the eutectic alloy blanket to form a secondary seal in the casing-casing annulus above the primary annular seal upon solidification; and a source of cement in selective fluid communication with the second ported collar through the interior of the second casing string.

18. The wellbore repair system of claim 17, further comprising a plurality of pressure cups within the second casing string and operable to seat around the differential valve tool, the first ported collar, the second ported collar, or a combination thereof such that a fluid may be introduced between the pressure cups to activate the differential valve tool, the first ported collar, the second ported collar, or the combination thereof.

19. The wellbore repair system of claim 18, further comprising a tool string within the second casing string and including the plurality of pressure cups thereon.

20. The wellbore repair system of claim 17, further comprising:

a pump in fluid communication with the source of flushing fluid and operable to pump the flushing fluid downhole; and a fluid line operable to receive the flushing fluid from the pump, wherein the fluid line is in fluid communication with the second casing string to supply the flushing fluid to the first ported collar.

* * * * *